US009251981B2

(12) United States Patent
Cernat et al.

(10) Patent No.: US 9,251,981 B2
(45) Date of Patent: Feb. 2, 2016

(54) ARRANGEMENT COMPRISING A CIRCUIT BREAKER UNIT

(75) Inventors: Radu-Marian Cernat, Berlin (DE); Volker Lehmann, Treuenbrietzen (DE); Andrzej Nowakowski, Berlin (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 14/348,150

(22) PCT Filed: Sep. 5, 2012

(86) PCT No.: PCT/EP2012/067260

§ 371 (c)(1), (2), (4) Date: Mar. 28, 2014

(87) PCT Pub. No.: WO2013/045234

PCT Pub. Date: Apr. 4, 2013

(65) Prior Publication Data

US 2014/0251957 A1 Sep. 11, 2014

(30) Foreign Application Priority Data

Sep. 28, 2011 (DE) ..... 10 2011 083 588

(51) Int. Cl.
*H01H 33/70* (2006.01)
*H01H 33/58* (2006.01)

(52) U.S. Cl.
CPC ..... *H01H 33/7015* (2013.01); *H01H 33/58* (2013.01)

(58) Field of Classification Search
CPC ..... H01H 33/04; H01H 33/08; H01H 33/53; H01H 33/56; H01H 33/58; H01H 33/70; H01H 33/7015; H01H 2009/523
USPC ..... 218/13, 41, 51, 57, 68, 93, 97, 61, 83
See application file for complete search history.

(56) References Cited

U.S. PATENT DOCUMENTS

| | | | | |
|---|---|---|---|---|
| 1,645,288 | A | 10/1927 | MacNeill | |
| 3,617,667 | A | 11/1971 | Kirschner et al. | |
| 4,328,403 | A * | 5/1982 | Frink et al. | 218/60 |
| 4,471,187 | A * | 9/1984 | Sturzenegger et al. | 218/51 |
| 6,207,917 | B1 | 3/2001 | Lehmann et al. | |
| 7,022,922 | B2 | 4/2006 | Nowakowski | |
| 7,041,928 | B2 | 5/2006 | Nowakowski | |
| 7,202,435 | B2 | 4/2007 | Claessens et al. | |
| 8,389,886 | B2 | 3/2013 | Dahlquist et al. | |
| 2005/0150868 | A1 * | 7/2005 | Nowakowski | 218/57 |
| 2011/0297648 | A1 * | 12/2011 | Dienemann et al. | 218/54 |

FOREIGN PATENT DOCUMENTS

| | | | |
|---|---|---|---|
| CA | 913152 | A | 10/1972 |
| CH | 522281 | A | 6/1972 |

(Continued)

*Primary Examiner* — Renee Luebke
*Assistant Examiner* — William Bolton
(74) *Attorney, Agent, or Firm* — Laurence Greenberg; Werner Stemer; Ralph Locher

(57) ABSTRACT

A circuit breaker unit has first and second arcing contact pieces. A breaker gap is formed between the two arcing contact pieces. A switching gas channel leads to the breaker gap and guides the switching gas to a switching gas outlet opening of the circuit breaker unit. The switching gas channel is formed with first and second pipe sections that overlap each other at least in sections and have discharge openings in their cover surfaces. Continuous discharge openings in the first and in the second pipe sections are axially offset in relation to each other.

6 Claims, 1 Drawing Sheet

(56) References Cited

FOREIGN PATENT DOCUMENTS

| | | | |
|---|---|---|---|
| DE | 1889068 | U | 3/1964 |
| DE | 29706202 | U1 | 6/1997 |
| DE | 10221580 | B3 | 1/2004 |
| EP | 1403891 | A1 | 3/2004 |
| EP | 1768150 | A1 | 3/2007 |
| WO | 03046939 | A1 | 6/2003 |

* cited by examiner

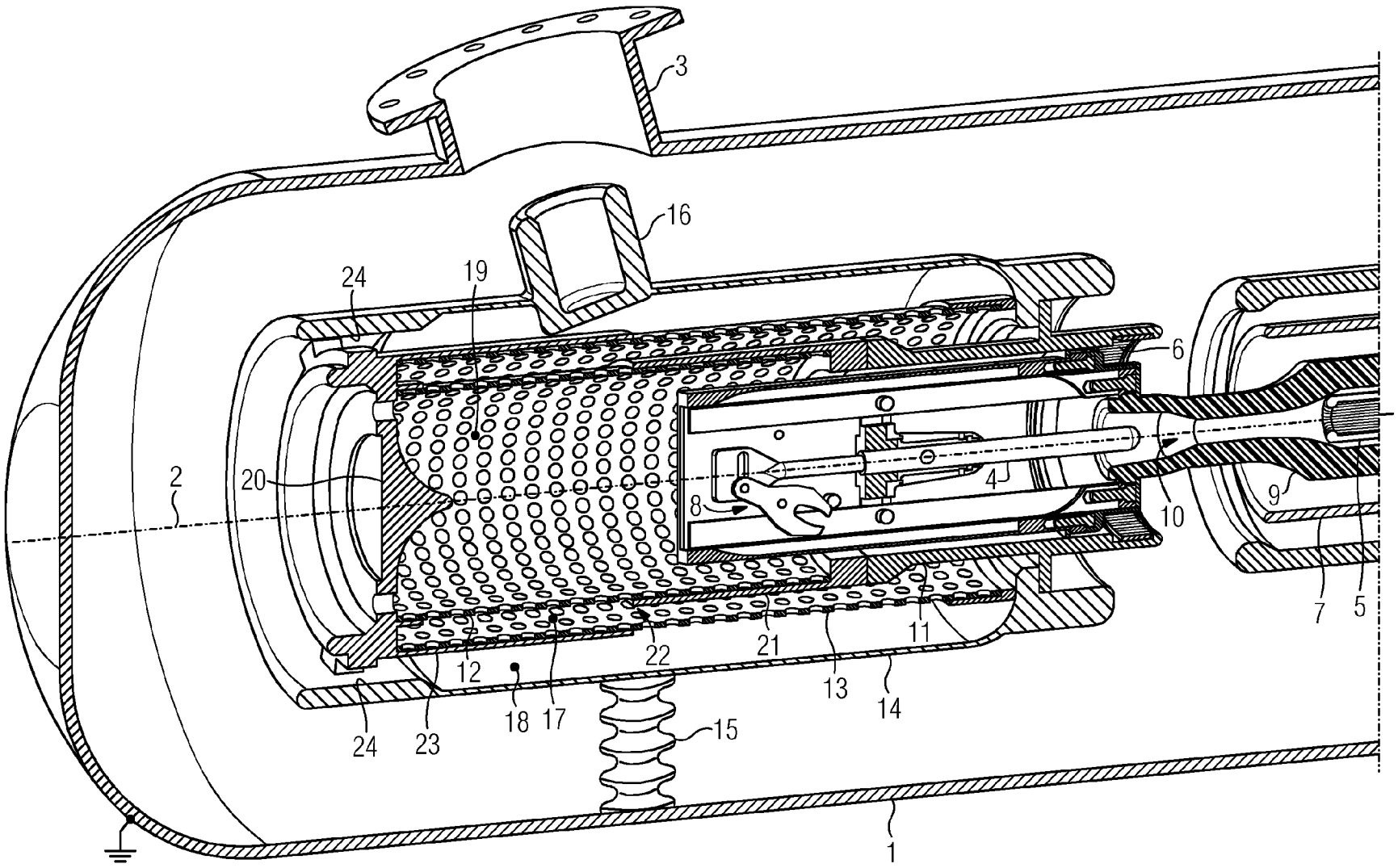
1
2
3
4
5
6
7
8
9
10
11
12
13
14
15
16
17
18
19
20
21
22
23
24
24

ARRANGEMENT COMPRISING A CIRCUIT BREAKER UNIT

BACKGROUND OF THE INVENTION

Field of the Invention

The invention relates to an arrangement comprising a circuit breaker unit having a breaker gap arranged between a first and a second arcing contact piece and having a switching gas channel, which leads on the one hand to the breaker gap and on the other hand to a switching gas outlet opening of the circuit breaker unit and which is delimited, at least in portions, by a first and a second pipe section, which overlap one another in the axial direction in an overlap segment and each have discharge openings in their lateral surfaces.

An arrangement of this type is known for example from the German utility model DE 1 889 068. There, a circuit breaker unit in the form of a pipe quenching chamber is described, which has a breaker gap between arcing contact pieces. In order to allow switching gas generated in the breaker gap to escape outwardly, the arrangement there is equipped with a switching gas channel which leads on the one hand to the breaker gap and on the other hand to a switching gas outlet opening in the pipe quenching chamber there. The switching gas channel is delimited in portions by a plurality of pipe sections, which overlap one another in an axial direction and form an overlap segment. Discharge openings are arranged in the lateral surface of the pipe sections.

Here, the use of a plurality of pipe sections is provided with the known arrangement, said pipe sections each comprising a number of discharge openings which are each aligned in the axial direction in the respective lateral surface. The pipe sections are arranged coaxially with an axis, wherein the discharge openings of the individual pipe sections are rotated relative to one another about the axis. A direct passing over of switching gas from one discharge opening into another discharge opening is prevented. Frequent deflection of the switching gas is thus also enforced. A good swirling of the switching gas is therefore indeed attained, however the flow resistance of the switching gas channel thus also increases.

A high flow resistance is counterproductive to a quick discharge of large quantities of switching gas.

BRIEF SUMMARY OF THE INVENTION

In this respect, the object of the invention is to form an arrangement comprising a circuit breaker unit in such a way that switching gas can be efficiently conducted away.

With an arrangement of the type mentioned in the introduction, this object is achieved in accordance with the invention in that unobstructed discharge openings in the first and in the second pipe section are offset axially in relation to one another.

A circuit breaker unit is part of an electric switching device. The circuit breaker unit comprises active parts of the electric switching device in order to interrupt an electric current or to switch on an electric current. The circuit breaker unit for this purpose comprises, for example, arcing contact pieces, at which switch-on or switch-off arcs, typically produced during switching processes, are guided. Besides the arcing contact pieces, nominal current contact pieces may also be provided, such that the functionality of current guidance and of arc guidance is divided between the nominal current contact pieces and the arcing contact pieces respectively. Between the arcing contact pieces, a breaker gap is formed, within which a switch-off or switch-on arc is guided. The breaker gap serves to galvanic ally contact the arcing contact pieces or to separate the arcing contact pieces. To this end, the arcing contact pieces are movable relative to one another. The switching gas channel leads here to the breaker gap, such that switching gas produced in the breaker gap can be conducted away from the breaker gap. In the absence of such a switching gas channel, a generation of switching gas in the breaker gap could lead to an undesirable pressure increase, which could ultimately lead to a destruction of the circuit breaker unit. Due to the thermal effect of an arc for example, switching gas can be generated from an insulating fluid. Furthermore, the switching gas can also be generated by a vaporization of solid materials, such as insulating materials or conducting materials. The temperature of the switching gas is usually increased excessively and also experiences an increase in volume due to the excessive increase in temperature.

For example, an electrically insulating fluid is located in the breaker gap, flows through the breaker gap and surrounds the electrically active parts of the interrupter unit. Here, the electrically insulating fluid serves to electrically insulate the active parts and flows through the circuit breaker unit. A fluid of this type has the advantage that, once an arc has appeared, an arcing channel is automatically filled again with uncontaminated electrically insulating fluid. Reference is made to what is known as self-healing electrical insulation. For example, electrically insulating gases, or electrically insulating liquids, such as oils, esters, etc., can be used as electrically insulating fluid. Sulfur hexafluoride, nitrogen and mixtures with these gases have proven to be suitable electrically insulating gases. The electrically insulating fluid should advantageously flush over the circuit breaker unit at an overpressure. The electric insulation strength of the fluid is increased by the overpressure.

The switching gas channel leads to the breaker gap and connects the breaker gap to a switching gas outlet opening, which is located in the periphery of the circuit breaker unit. Switching gas at overpressure in the breaker gap can thus be conducted through the interrupter unit over a defined path to a switching gas outlet opening via the switching gas channel in order to then flow off into the environment surrounding the circuit breaker unit. The environment surrounding the circuit breaker unit is filled for example with a fluid, with which the switching gas flowing out from the switching gas outlet opening can be swirled and mixed. This fluid may be identical to the fluid located within the circuit breaker unit and may be connected thereto. The switching gas channel can be guided within the circuit breaker unit, for example within an overlap segment, which is formed by the overlap between two pipe sections. The overlap segment extends in an axial direction. Here, a first pipe section has a smaller cross section than a second pipe section; such that an annular portion of the switching gas channel is delimited by the outer lateral surface of the inner pipe portion and by the inner lateral surface of the outer second pipe section and can serve to guide and direct switching gas. The switching gas channel thus has an annular cross section in the overlap region of the pipe sections. The pipe sections should each advantageously have similar cross sections, such that an annular cross section with body edges running in parallel is formed. The pipe sections should preferably each have annular cross sections, such that the portion of the switching gas channel delimited in the overlap region has an annular cross section. The pipe sections should have cross sections similar to one another in the region of overlap of the pipe sections. An arrangement of discharge openings in the lateral surfaces of the pipe sections makes it possible, besides an axial guidance of switching gas within the pipe sections, to also enable a radial discharge of the switching gas through the walls of the pipe sections. An axial offset in relation to one another of the discharge openings in the first and in the second pipe section enables a radial escape of switching gas through the discharge openings, wherein a direct escape of switching gas from a discharge opening of one pipe section into a discharge opening of the other pipe section is prevented. It is thus ensured that a discharge opening which is unobstructed is spanned by a wall of the other tube portion. It is further ensured that the switching gas is deflected radially before flowing into a discharge opening, or that the switching gas is deflected axially after exiting from a discharge opening.

In a projection in the direction in which switching gas passes through a discharge opening, a wall thus always covers the respective other pipe section. A baffle is thus provided before/after each unobstructed discharge opening in the direction in which switching gas passes through said opening. An effective swirling and mixing of the switching gas with insulating fluid located within the switching gas channel is thus ensured. Here, an axial offset can be designed in such a way that discharge openings are arranged in each case over practically the entire length of the tube portions, wherein an axial offset is enforced by a closure, as required, of individual discharge openings. In addition, a group of discharge openings in the first or in the second pipe section may also be arranged in a manner axially distanced from a group of discharge openings in the second or in the first pipe section respectively.

Due to an axial offset, a discharge of switching gas in radial directions is enabled, such that enlarged switching gas quantities can be passed through the switching gas channel within short intervals, wherein the flow resistance experiences only a limited flow resistance increase in spite of a swirling and deflection of the switching gas. The unobstructed discharge openings may be located in the first and in the second pipe section in a manner alternating a number of times in axial sequence. It may also be that, at the pipe sections, one pipe section has unobstructed discharge openings merely at one end-face end of the overlap segment, whereas the other pipe section has unobstructed discharge openings at the other end-face end of the overlap region. Groups of unobstructed discharge openings can be located in the first or in the second pipe section at each of the end-face ends.

In accordance with a further advantageous embodiment, only one of the pipe sections has unobstructed discharge openings within the overlap segment over an azimuthal path with respect to the axial direction.

Due to the definition of one or more azimuthal paths with respect to the axial direction, with respect to which hollow-cylindrical pipe sections for example also may each be arranged coaxially, and also a provision of continuous discharge openings in each case only on one of the two pipe sections, there is the risk that radially aligned discharge openings are prevented in both pipe sections. A baffle wall is thus provided above/before a respective continuous discharge opening, as a result of which switching gas exiting from a discharge opening is deflected at the baffle wall or switching gas flows into a discharge opening with a change to the flow direction. An effective swirling and cooling of the switching gas is thus enabled. Furthermore, it is thus made possible to form a number of discharge openings over the azimuthal path within a pipe body and to thus enable a deflection of switching gas in many radial directions over the azimuthal path. A large overall cross section through a number of discharge openings can thus be provided in order to allow large volumes of switching gas to flow through the switching channel and in so doing to have a favorable cooling effect. For example, a plurality of azimuthal paths may be arranged in the two pipe sections surrounding one another, said azimuthal paths enabling switching gas to flow out radially. These azimuthal paths can be arranged in the first or the second pipe section offset in relation to one another alternately in the axial direction. Groups of discharge openings in the first or in the second pipe section may also be offset axially in relation to one another however, such that a deflection of the switching gas in the radial direction at the first pipe section is enforced and a further directing of the switching gas in the axial direction is then implemented in order to then be able to flow again in the radial direction through the discharge opening of the second pipe section.

Besides the use of two pipe sections surrounding one another which, within an overlap segment, delimit a switching gas channel on the lateral surface side, a use of a greater number of pipe sections overlapping one another may also be provided, such that a number of portions of the switching gas channel following one another in a shell-like manner are provided and follow on from one another radially in the same axially extending overlap region. Accordingly, with a use of more than two pipe sections, the axial offset of unobstructed discharge openings can be based on the pipe sections arranged immediately adjacently to one another and jointly delimiting a portion of a switching gas channel. Further pipe sections not directly adjacent may have discharge openings arranged in an aligned manner over the same azimuthal path, where appropriate, wherein a baffle wall is formed by an interposed pipe section, which can be arranged in each case directly adjacently to the two other pipe sections.

In accordance with a further advantageous embodiment, one discharge opening, in particular a plurality of discharge openings, is/are closed at least in one of the pipe sections by a fitting body. Due to the use of a fitting body, it is possible to close discharge openings in at least one of the pipe sections. For example, depending on the expected switching gas volumes or cooling performance to be attained, a different number of discharge openings can thus be made effective. Due to the use of fitting bodies, it is possible to limit the free passage through discharge openings and to allow merely a limited number of discharge openings to function in the circuit breaker unit. Due to the adaptation of the fitting body, it is possible, with constant pipe sections, to vary the cooling performance thereof as a result of varying covering or as a result of a varying covering of discharge openings. Furthermore, the flow profile of switching gas within the switching gas channel can be controlled by covering discharge openings. For example, annular bodies which are slid onto/into the pipe sections such that at least one pipe section and in particular both pipe sections is/are covered in portions by one or more annular bodies can be used as fitting bodies. Here, the cross section of the pipe body is to be selected in a manner as complementary as possible to the shape of the respective pipe section. For example, a fitting body may thus sit on a pipe section on the outer lateral surface side. It may also be provided however for a fitting body to be inserted into a pipe body on the inner lateral surface side. Due to the shape matching, the fitting body rests flush against the respective pipe section, such that discharge openings are terminated and closed as tightly as possible. The number of closed discharge openings can be varied by varying the dimension of the fitting body. Furthermore, the position of the fitting body relative to the pipe body can be varied. Furthermore, at least one fitting body may serve to hold or position a pipe section on the circuit breaker unit. Furthermore, the pipe sections may advantageously be encompassed in each case at the end face by a fitting body, and the fitting body may protrude from opposite directions into the overlap segment in such a way that the fitting bodies end at a common path running around the axial direction.

The fitting body may be arranged on the two pipe sections in each case at the end face for example, wherein the fitting body can serve here to hold and position the pipe sections. It is thus possible to orientate the two pipe sections coaxially in relation to one another, for example by means of the fitting body, and to fix the course of the switching gas channel. If the pipe sections are now equipped with fitting bodies in each case at the end face, wherein the fitting bodies are each arranged at opposite ends with respect to the axial direction of the pipe bodies, it is thus possible to allow a region of the fitting body closing discharge openings to run from opposite ends into a central region of the overlap segment arranged between the ends of the pipe bodies. Ends oriented oppositely to one another, specifically end faces of the pipe sections, are thus in each case spanned or covered by the fitting bodies, such that merely the portions of the pipe bodies not facing away from the fitting bodies with the discharge openings arranged there can serve to allow switching gas to pass through radially. The path running around may run around the axial direction in a manner closed per se, and may have different shapes. For example, the path may have a circular shape, an elliptical shape, an undulating shape, a sawtooth shape, etc. The fitting bodies contact this path with a complementary shape from opposite directions and end at said path. For example, the path may run around azimuthally. Due to the spacing between the pipe bodies, the path is contacted in each case merely in a projection transversely, in particular radially, to the axial direction. The path thus constitutes a virtual contact edge of complementary shape. Switching gas may thus pass over in the region of the encircling path over a short route from a discharge opening of one pipe section into a discharge opening of the other pipe section, wherein the switching gas flow is provided with an axial flow direction as it passes over. With the contacting of a path, it is thus made possible to guide the switching gas centrally, for example firstly within the first pipe section, since the switching gas cannot initially be diverted in radial directions due to the covering of the discharge openings by means of a fitting body and can only flow over the following portion in a radial direction. A further radial flow of the switching gas is prevented by the second pipe section or by the fitting body, which covers discharge openings located in the second pipe section. An axial flow is thus initially enforced in turn. Accordingly, the switching gas can in turn be deflected radially through discharge openings within the second pipe body once the covering of the second fitting body has been passed. A deflection of the switching gas by 180° can thus be enforced, wherein the switching gas channel has a meandering course.

Due to the use of fitting bodies, it is possible to partially cover pipe bodies, for example comprising continuous discharge openings, by means of the fitting bodies, wherein the fitting bodies each span only part of the overall overlap segment of the two pipe sections in the axial direction.

In accordance with a further advantageous embodiment at least one of the pipe sections may comprise a perforated plate with discharge openings arranged symmetrically in the pipe section.

The use of perforated plates makes it possible to form pipe bodies in a standardized manner and to implement a distribution that is as symmetrical as possible of a plurality of discharge openings in the lateral surface of said pipe bodies. For example, discharge openings may structure the perforated plate in a grid-like manner, such that a plurality of intersecting webs are produced between the discharge openings and ensure a torsional rigidity of the pipe body. For example, the discharge openings may each be distributed symmetrically over azimuthal paths, wherein the discharge openings are aligned linearly in the axial direction. In this case, the webs intersect at right angles. Discharge openings may also be distributed however in a manner offset in relation to one another over directly adjacent azimuthal paths. In this case, the webs do not intersect at right angles. For example, a pipe body can be formed by rolling, bending, etc. a perforated plate.

In accordance with a further advantageous embodiment, the circuit breaker unit may be surrounded by an encapsulating housing.

The arrangement of a circuit breaker unit within an encapsulating housing makes it possible to form the encapsulating housing in a fluid-tight manner, such that an electrically insulating fluid flushing over or flushing through the circuit breaker unit is encapsulated and a sporadic volatilization of said electrically insulating fluid is suppressed to the greatest possible extent. The encapsulating housing thus constitutes a barrier for the electrically insulating fluid and may also be formed as a pressure-resistant encapsulating housing, such that electrically insulating fluid enclosed within the encapsulating housing can also be acted on by a pressure that is increased with respect to the environment surrounding the encapsulating housing. The encapsulating housing surrounds the circuit breaker unit, wherein the interior of the encapsulating housing defines the environment surrounding the circuit breaker unit. The switching gas channel, which connects the breaker gap to an environment surrounding the circuit breaker unit thus constitutes a connection between the breaker gap and the interior of the hermetically sealed-off encapsulating housing via the switching gas channel and the switching gas outlet opening. It is thus possible to allow switching gas to discharge relatively quickly from the interior of the circuit breaker unit into the environment surrounding the circuit breaker unit and to already cool the switching gas in a preliminary manner in this way, such that a further swirling, mixing and cooling of the switching gas, which is already pre-cooled, with the electrically insulating fluid located within the encapsulating housing can take place outside the circuit breaker unit within the encapsulating housing.

Here, the encapsulating housing should be formed in such a way that phase conductors can be introduced in a electrically insulated manner through the encapsulating housing into the interior thereof so as to be contacted there with the arcing contact pieces, such that a current path can be interrupted or switched on, wherein the arrangement with the circuit breaker unit is located in an electric power transmission network. Here, the circuit breaker unit should be supported on the encapsulating housing in an electrically insulating manner. To this end, the encapsulating housing may be electrically insulating itself for example, at least in portions. The encapsulating housing may also be formed however from electrically conductive material, preferably material conducting earth potential, at least in portions, wherein the circuit breaker unit should be supported in an electrically insulated manner, for example by means of post insulators, with respect to these electrically conductive portions.

An exemplary embodiment of the invention will be shown schematically hereinafter in a drawing and described hereinafter in greater detail.

BRIEF DESCRIPTION OF THE SEVERAL VIEWS OF THE DRAWING

Here, the FIGURE shows a section through an arrangement comprising a circuit breaker unit that is arranged in an encapsulating housing.

DESCRIPTION OF THE INVENTION

The FIGURE shows a partly cut-away arrangement comprising a circuit breaker unit which is arranged within an encapsulating housing 1. The encapsulating housing 1 in the present case has a metal cast body, which carries ground potential. The interior of the encapsulating housing 1 is filled with an electrically insulating fluid, preferably an electrically insulating gas, such as sulfur hexafluoride or nitrogen or a mixture with the gases. The electrically insulating fluid is exposed here to overpressure. Due to the design of the encapsulating housing 1, which allows said housing to be sealed off hermetically, a sporadic volatilization of the electrically insulating fluid at overpressure is only possible with difficulty.

The encapsulating housing 1 extends substantially in a tubular manner coaxially with a longitudinal axis 2, wherein the end sides of the encapsulating housing 1 are closed by cap-like closure elements. The longitudinal axis 2 defines an axial direction. Furthermore, the encapsulating housing 1 comprises connection flanges, of which one exemplary connection flange 3 is illustrated in the FIGURE. By means of the connection flanges, it is possible to access the interior of the encapsulating housing 1, wherein all connection flanges are closed in a fluid-tight manner under operating conditions.

In the interior of the encapsulating housing 1, a circuit breaker unit extends substantially coaxially with the longitudinal axis 2. The circuit breaker unit comprises a first arcing contact piece 4 and a second arcing contact piece 5. The two arcing contact pieces 4, 5 are diametrically opposed and displaceable along the longitudinal axis 2, wherein the arcing contact pieces 4, 5 are oriented substantially coaxially with the longitudinal axis 2. The first arcing contact piece 4 is pin-shaped. The second arcing contact piece 5 is socket-shaped in a diametrically opposed manner. A first nominal current contact piece 6 is associated with the first arcing contact piece 4. A second nominal current contact piece 7 is associated with the second arcing contact piece 5. The two nominal current contact pieces 6, 7 are arranged coaxially with the two arcing contact pieces 4, 5 and have contact regions of complementary shape. The first arcing contact piece 4 and the first nominal current contact piece 6 and also the second arcing contact piece 5 and the second nominal current contact piece 7 are permanently electrically conductively connected to one another, such that the first arcing contact piece 4 and the first nominal current contact piece 6 and also the second arcing contact piece 5 and the second nominal current contact piece 7 permanently carry the same electric potential.

The two arcing contact pieces 4, 5 are displaceable relative to the longitudinal axis 2. To this end, the first arcing contact piece 4 is equipped with a transmission 8, such that the two arcing contact pieces 4, 5 are always movable with opposed sense of direction. The first nominal current contact piece 6 is mounted non-displaceable with respect to the longitudinal axis 2. Merely the second nominal current contact piece 7 is arranged displaceable along the longitudinal axis 2. A movement of the arcing contact pieces 4, 5 and also of the nominal current contact pieces 6, 7 relative to one another is synchronized here in such a way that, in the event of a switch-on process, the arcing contact pieces 4, 5 contact one another first and the nominal current contact pieces 6, 7 then contact one another. In the event of a switch-off process, the nominal current contact pieces 6, 7 are first separated, whereas the arcing contact pieces 4, 5 are then separated chronologically subsequently. Due to a synchronization of this type of the movements of arcing contact pieces 4, 5 and nominal current contact pieces 6, 7, it is ensured that an arc is guided preferably between the arcing contact pieces 4, 5. Here, an arc may be a switch-on arc or also a switch-off arc, which potentially ignites in the event of a switch-on or a switch-off process respectively. The arcing contact pieces 4, 5 thus protect the nominal current contact pieces 6, 7 against erosion caused by an arc.

An insulating material nozzle 9 is arranged coaxially with the two arcing contact pieces 4, 5. The insulating material nozzle 9 is connected at a fixed angle to the second arcing contact piece 5 and has an insulating material nozzle channel. The insulating material nozzle channel delimits a breaker gap 10 formed between the arcing contact pieces 4, 5. In the switched-off state, as shown in the FIGURE, the first arcing contact piece 4 protrudes at least in part into the insulating material nozzle channel of the insulating material nozzle 9. In the event of a switching process, an arc is thus preferably guided in the breaker gap in a manner delimited by the insulating material nozzle 9. Switching gas generated by an arc, heated, and enlarged in terms of volume preferably flows away from the breaker gap 10 in the direction of the first arcing contact piece 4. In order to promote a flowing-off in this direction, the insulating material nozzle channel of the insulating material nozzle 9 is formed in a funnel-shaped manner widened in the direction of the first arcing contact piece 4.

The first nominal current contact piece 6 is carried by a pipe connection 11. The pipe connection 11 surrounds the first arcing contact piece 4. The free end of the insulating material nozzle 9 remote from the second arcing contact piece 5 also protrudes into the pipe connection 11. A switching gas channel leads to the breaker gap 10 and is continued in the axial direction subsequently to the insulating material nozzle 9 via the pipe connection 11. The pipe connection 11 thus forms a portion of the switching gas channel arranged coaxially with the longitudinal axis 2, wherein the first arcing contact piece 4 and the transmission 8 protrude into this portion of the switching gas channel. The pipe connection 11 is adjoined by a first pipe section 12. The first pipe section 12 is hollow-cylindrical, wherein the lateral surfaces thereof are penetrated by discharge openings. The first pipe section 12 and parts of the pipe connection 11 are surrounded by a second pipe section 13. The second pipe section 13 comprises discharge openings on the lateral surface over practically its entire length. Both the first pipe section 12 and the second pipe section 13 are in turn surrounded by a third pipe section 14, wherein the third pipe section 14 serves as a phase conductor for contacting the first arcing contact piece 4 and also the first nominal current contact piece 6, and positions both the first arcing contact piece 4 and the first nominal current contact piece 6 and also enclosed component parts, such as the first and second pipe section 12, 13. The third pipe section 14 is supported in an electrically insulated manner on the encapsulating housing 1, for example via a post insulator 15. Furthermore, the third pipe section 14, on the lateral surface, comprises a radially outwardly protruding female connector 16. By means of this female connector 16, the third pipe section 14 can be electrically contacted via a connection phase conductor introduced in an electrically insulated manner into the interior of the encapsulating housing by means of the exemplary connection flange 3. To this end, a fluid-tight outdoor bushing acting in an electrically insulating manner can be fitted onto the exemplary connection flange 3. It is thus possible to integrate the circuit breaker unit into an electric power transmission network under outdoor conditions.

The interior of the third pipe section 14 is divided by the second pipe section 13 and by the first pipe section 12 into number of hollow-cylindrical sub-volumes surrounding one another. A first hollow-cylindrical sub-volume 17 is arranged between the first pipe section 12 and the second pipe section 13. A second hollow-cylindrical sub-volume 18 is arranged between the second pipe section 13 and the third pipe section 14. The two hollow-cylindrical sub-volumes 17, 18 surround a centrally positioned central cylinder volume 19 surrounded by the first pipe section 12. The end of the first pipe section 12 facing the breaker gap 10 is connected flush at the end face to the pipe connection 11. The end of the first pipe section 12 remote from the breaker gap 10 is closed at the end face by a closure element 20. The closure element 20 serves as a deflection body in order to deflect in radial directions switching gas flowing into the switching gas channel from the breaker gap 10 in the axial direction along the longitudinal axis 2. At its end facing the breaker gap 10, the first pipe section 12 is surrounded by a fitting body 21. The fitting body 21 serves to connect the first pipe section 12 to the pipe connection 11 and for this purpose surrounds the pipe body on the puter lateral surface side. Here, the fitting body 21 is slid far hollow-cylindrically onto the outer contour of the first pipe section 12 in such a way that practically half of the first pipe section 12 is spanned by the fitting body 21 and discharge openings arranged in this portion are closed by the fitting body 21. The fitting body 21 ends at an azimuthal path 22. The region of the first pipe section 12 not spanned by the fitting body 21 comprises, at its end remote from the breaker gap 10, unobstructed discharge openings which enable a radial deflection of switching gas.

The second pipe section 13 is likewise held by a fitting body 23. Here, the fitting body 23 is arranged at the end of the second pipe section 13 remote from the breaker gap 10 and surrounds the second pipe section 13 on the outer lateral surface side, wherein the fitting body 23 rests flush against the second pipe section 13 on the outer lateral surface side, extending in the direction of the breaker gap 10 and closes discharge openings provided there. The fitting body 23 extends here in the direction of the breaker gap 10 as far as the azimuthal path 22, at which the fitting body 21, which surrounds the first pipe section 12, ends. The free ends of the fitting bodies 21, 23, which each protrude in the direction of a center of the overlap segment of the two pipe bodies 12, 13, are thus formed in a manner ending at a vertical plane, adjoining the azimuthal path 22. The discharge openings arranged in an unobstructed manner on the first pipe section 12 are thus spanned on the outer face by a baffle wall, whereas the discharge openings arranged in the second pipe section 13 on the lateral surface are in turn spanned by a baffle wall on the inner face in the radial direction. It is thus ensured that radial discharge openings arranged in the first and in the second pipe section 12, 13 are offset in relation to one another in the axial direction in the respective pipe section 12, 13.

In the present case, a number of groups of discharge openings are formed in the first and second pipe section 12, 13, wherein each individual discharge opening of the respective group is axially offset in relation to each individual discharge opening of the respective other group with respect to the longitudinal axis 2. The discharge openings themselves can be arranged in a large number of radial directions in the lateral surface of the respective pipe section 12, 13.

The overlap segment between the first pipe section 12 and the second pipe section 13 is closed at each end face, such that an entry or exit of switching gas into/from the portion of the switching gas channel formed in the overlap segment with annular cross section between the two pipe sections 12, 13 can flow into said portion or can flow off from said portion exclusively in radial directions in each case. Switching gas flows into and out from the portion of the switching gas channel with annular cross sections in radial directions. A deflection of the switching gas at least once by 180° is thus enforced, wherein, in the interest of a high gas throughput, a meeting of the axial offset of discharge openings remains limited where possible to an azimuthal path 22, wherein the free discharge openings offset in relation to one another extend on either side of this azimuthal path 22 in the axial direction.

Once the switching gas has exited through the discharge openings in the second pipe section 13 in radial directions, the switching gas blasts against the third pipe section 14, which in the present case has no outlet openings in the radial direction. Instead, an arrangement of a plurality of switching gas outlet openings 24 is provided on the end face at the end remote from the breaker gap 10 and enables switching gas to exit from the circuit breaker unit into the environment surrounding the circuit breaker unit. Radially oriented switching gas outlet openings may also be arranged however in the third pipe section 14.

A direct route from the breaker gap to the environment surrounding the circuit breaker unit, that is to say to the volume encapsulated by the encapsulating housing 1, is thus provided via the switching gas channel, which on the one hand leads to the breaker gap 10, via the discharge openings in the two pipe sections 12, 13, and also via the pipe sections 12, 13 themselves to the switching gas outlet openings 24. Overpressures, which may be produced in the breaker gap during a switching process, can thus be relieved in the environment surrounding the circuit breaker unit, such that an irreversible influencing of the circuit breaker unit is prevented.

The invention claimed is:

1. A circuit breaker unit assembly, comprising:

a first arcing contact piece and a second arcing contact piece and a breaker gap between said first and second arcing pieces;

a switching gas channel leading from said breaker gap to a switching gas outlet opening of the circuit breaker unit;

first and second pipe sections delimiting said switching gas channel, at least in portions thereof, said first and second pipe sections overlapping one another in an axial direction within an overlap segment;

each of said first and second pipe sections having lateral surfaces formed with discharge openings, and wherein unobstructed discharge openings in said first and second pipe sections are axially offset relative to one another; and fitting bodies respectively encompassing said pipe sections at end faces thereof, with said fitting bodies protruding from opposite directions into said overlap segment such that said fitting bodies end at a common path running around the axial direction.

2. The assembly according to claim 1, wherein only one of said first and second pipe sections is formed with unobstructed discharge openings within said overlap segment over an azimuthal path.

3. The assembly according to claim 1, wherein at least one of said fitting bodies is disposed to close at least one discharge opening at least in one of said first and second pipe sections.

4. The assembly according to claim 3, wherein said at least one fitting body is disposed to close a plurality of said discharge openings.

5. The assembly according to claim 1, wherein at least one of said first and second pipe sections comprises a perforated plate with discharge openings formed symmetrically in said pipe section.

6. The assembly according to claim 1, which comprises an encapsulating housing surrounding the circuit breaker unit.

* * * * *